US006655537B1

(12) United States Patent
Lang et al.

(10) Patent No.: US 6,655,537 B1
(45) Date of Patent: Dec. 2, 2003

(54) SUPPORT RACK FOR PLASTIC CONTAINERS

(75) Inventors: Christopher F. Lang, Racine, WI (US); Timothy S. Jones, Acworth, GA (US); David Andersen, Racine, WI (US); Ron Dir, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 09/769,578

(22) Filed: Jan. 25, 2001

(51) Int. Cl.[7] ..... A47G 29/00

(52) U.S. Cl. ..... 211/85.31; 211/181.1; 211/119; 248/99

(58) Field of Search ..... 211/106, 181.1, 211/85.31, 106.01, 112, 113, 118, 119, 45, 12, 85.15; 248/153, 302–303, 99–100, 218.1, 304, 306, 215, 339–340, 322; D6/566; 223/85; 40/617; 383/22–24, 26; 24/716

(56) References Cited

U.S. PATENT DOCUMENTS

| | | | | | |
|---|---|---|---|---|---|
| 1,087,067 | A | * | 2/1914 | Loudenslager | 211/117 |
| 2,039,497 | A | * | 5/1936 | Simons | 211/120 |
| 2,456,535 | A | * | 12/1948 | Rundell | 211/106 |
| 2,603,438 | A | * | 7/1952 | Adams | 248/117.1 |
| 2,873,034 | A | * | 2/1959 | Laing | 211/17 |
| 2,902,167 | A | * | 9/1959 | Smith | 211/34 |
| D191,484 | S | * | 10/1961 | Bardo et al. | D6/566 |
| 3,175,793 | A | * | 3/1965 | Kennedy | 248/302 |
| 3,370,715 | A | * | 2/1968 | Kolozsvari | 211/115 |
| 3,646,723 | A | | 3/1972 | Meroney | 53/390 |
| 3,759,505 | A | * | 9/1973 | Callanan | 211/85.31 |
| 4,193,504 | A | * | 3/1980 | Berkowitz | 211/119 |
| 4,418,835 | A | | 12/1983 | Watts | 220/404 |
| D284,426 | S | * | 7/1986 | Morris | D6/317 |
| 4,728,070 | A | | 3/1988 | Engelbrecht | 248/303 |
| 4,974,799 | A | | 12/1990 | Palmer | 248/95 |
| 5,060,809 | A | * | 10/1991 | Bayes et al. | 211/12 |
| 5,092,548 | A | * | 3/1992 | Bayes et al. | 248/100 |
| 5,356,061 | A | * | 10/1994 | Yu | 211/106 |
| D362,577 | S | * | 9/1995 | Green | D6/566 |
| 5,667,173 | A | * | 9/1997 | Wilfong et al. | 248/100 |
| 5,894,940 | A | * | 4/1999 | Gusdorf et al. | 211/103 |
| 5,934,489 | A | * | 8/1999 | Dusel et al. | 211/106 |
| 6,102,218 | A | * | 8/2000 | Alfonso et al. | 211/119 |
| 6,109,460 | A | * | 8/2000 | Herlevi et al. | 211/106 |
| 6,182,934 | B1 | * | 2/2001 | Kelley | 248/302 |
| 6,216,305 | B1 | * | 4/2001 | Joh | 15/104.92 |
| 6,264,035 | B1 | * | 7/2001 | Petrie | 206/554 |

FOREIGN PATENT DOCUMENTS

| | | | |
|---|---|---|---|
| CA | 1 229 825 | 12/1987 | 220/9 |
| EP | 0 329 532 A1 | 8/1989 | |
| EP | 0 864 479 A1 | 9/1998 | |
| FR | 1 303 386 | 9/1962 | |
| GB | 2 285 086 | 6/1995 | |

OTHER PUBLICATIONS

A 14 page brochure by Buckeye International, Inc. dated Jul. 1999 entitled "Smart System", illustrating flexible bags with cleaners.

A one–page advertisement by Buckeye International, Inc., undated, admitted prior art, entitled "Smart System", illustrating a flexible bag with a cleaner.

* cited by examiner

*Primary Examiner*—Blair M. Johnson
*Assistant Examiner*—Jennifer E Novosad
(74) *Attorney, Agent, or Firm*—Neil E. Hamilton; Warren R. Bovee; Renee J. Rymarz

(57) ABSTRACT

A support rack for a plastic container having a content in excess of 1.5 gallons of liquid. Two or more support members extend from a wire body section, for engagement with apertures in the plastic container. A connecting section extends between the support members of first sides thereof, and supporting sections extend from second sides thereof for connection to a suspending support member. In one embodiment the support members are U-shaped and in another embodiment they are finger members. The support rack can be connected to the suspending support member in a stationary or swivel manner or can be part of a rolling cart.

3 Claims, 5 Drawing Sheets

SUPPORT RACK FOR PLASTIC CONTAINERS

CROSS-REFERENCE TO RELATED APPLICATIONS

NONE

STATEMENT REGARDING FEDERALLY SPONSORED RESEARCH OR DEVELOPMENT

NONE

BACKGROUND OF THE INVENTION

1. Technical Field

This invention relates to a supporting device for containers. More particularly, this invention relates to a support rack for large plastic bags filled with concentrated liquid cleaning and sanitizer products.

2. Background Art

Until recently, concentrated liquid cleaning and sanitizer products were supplied in rigid or semi-rigid plastic bottles. It has now become the practice to supply concentrated liquid cleaning and sanitizer products in flexible plastic bags somewhat the same as hospital solutions are supplied. The plastic bags offer many advantages such as cost savings, easy to handle larger containers, reduction in shipping weight and visibility of product. These advantages become more apparent when the flexible bags are of a large capacity such as 1.5 gallons. As the large flexible bags are not self-supporting, some means for supporting them in an efficient manner must be provided.

The objects of the invention therefore are:

a. Providing a support rack for a large capacity flexible bag.

b. Providing a support rack which affords a storing of the large capacity flexible bags in a versatile and easy manner.

c. Providing a support rack of the foregoing type which is durable.

d. Providing a support rack of the foregoing type which affords complete emptying of the bag.

e. Providing a support rack of the foregoing type which in some instances is movable.

SUMMARY OF THE INVENTION

The foregoing objects are accomplished by the support rack of this invention for a plastic container having a content of at least 1.5 gallons of liquid which has a wire body section. The body section includes at least two support members for engagement with at least two apertures in the plastic bag. A connecting section extends between the support members at first sides thereof, and supporting sections extend from second sides thereof for connection to a suspending support member.

In one aspect, the at least two support members are provided by two upwardly extending, essentially U-shaped members and the supporting sections are provided by two spaced apart hook members for connection to a suspending support member in a vertical manner.

In another aspect, the at least two support members are defined by two upwardly extending, essentially U-shaped members and the supporting sections are defined by an upper and lower leg section for connection to a suspending support member in a swivel manner.

In yet another aspect, the at least two support members are defined by two upwardly extending essentially U-shaped members and the supporting sections are defined by two spaced apart arm sections for connection to a wall surface.

In another embodiment, the at least two support members are defined by a multiplicity of finger members and the supporting sections are defined by extensions of the finger members.

In yet another embodiment, a rolling cart is connected to the extensions of the finger members.

In still another embodiment, the finger members include undulations.

DESCRIPTION OF THE PREFERRED EMBODIMENTS

Figure 1:
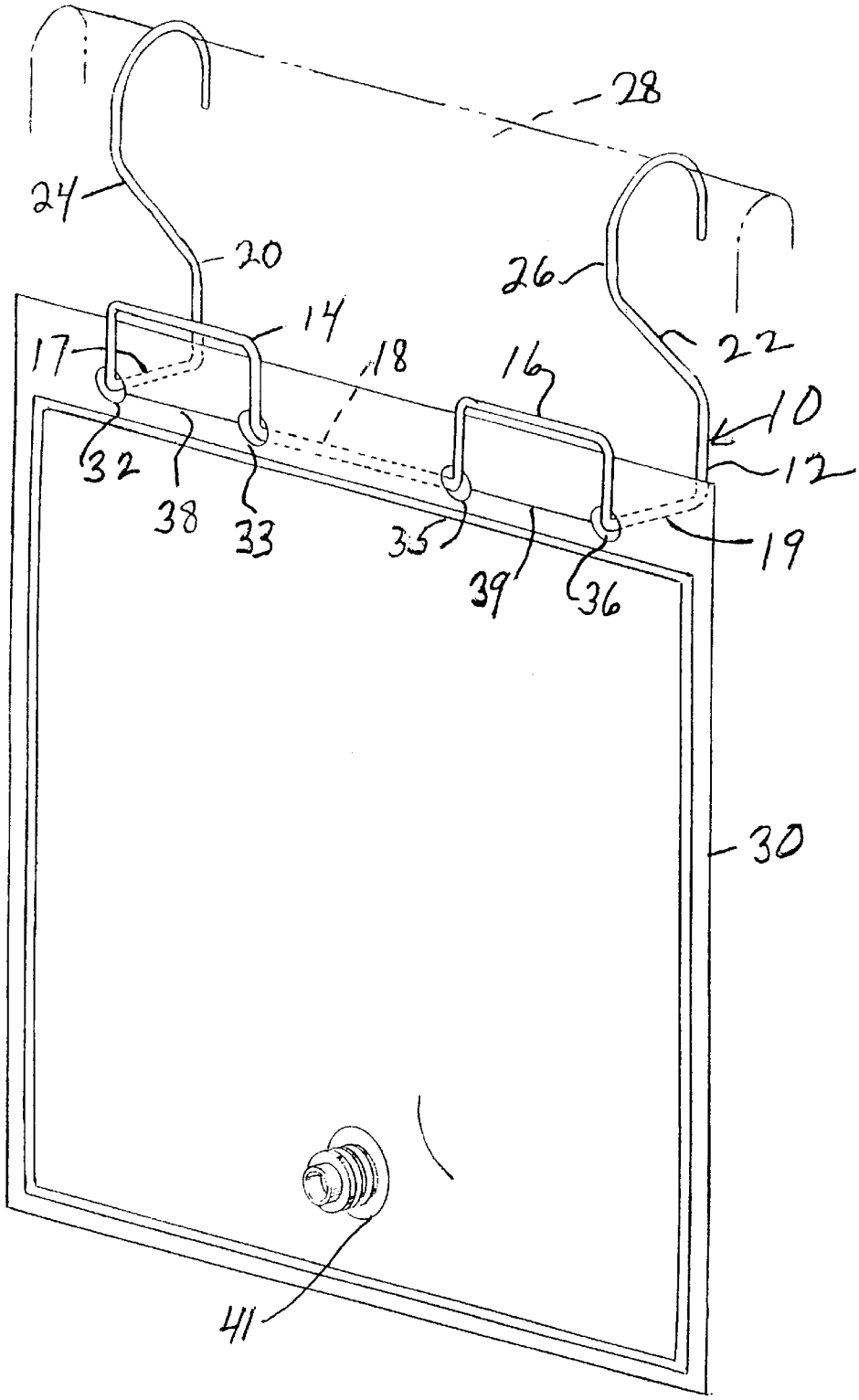
FIG. 1 is a perspective view of the rack of this invention supporting a flexible bag.

Referring to FIG. 1, the support rack generally 10 includes a wire body section 12 with two support members 14 and 16 extending in an upwardly position. A connecting section 18 joins the two support members 14 and 16. Extending from the support members 14 and 16 are two supporting sections 20 and 22 which include horizontal portions 17 and 19 and terminate in hook members 24 and 26, respectively. The hook members 24 and 26 engage a suspending member 28 which is the lip of a sink.

Support members 14 and 16 extend through openings 32, 33 and 35, 36 of flexible bag 30. Bag 30 is preferably composed of a transparent polyethylene and nylon plastic material with a nylon layer sandwiched between two layers of polyethylene. It is designed to hold at least two gallons of a liquid cleaner or sanitizer product. It should be noted that the openings 32, 33 and 35, 36 are connected by the slits 38 and 39, respectively. This is not only for the purpose of allowing the support members 14 and 16 to be positioned in the openings 32, 33 and 35, 36, but also as an aid in preventing undesired entanglement during handling of empty bags. A valved outlet 41 is provided in the bag 30 for purposes of delivering the contents to a dispensing system such as that provided by the Solutions Center™ Wall-Mount Dispensing System available from Johnson Wax Professional of Sturtevant, Wis. A valved cap connector (not shown) would engage the valved outlet 41 in a manner so that when the connector cap is screwed on to the outlet 41 a valve in the connector as well as the valve in the outlet 41 are opened.

Figure 2:
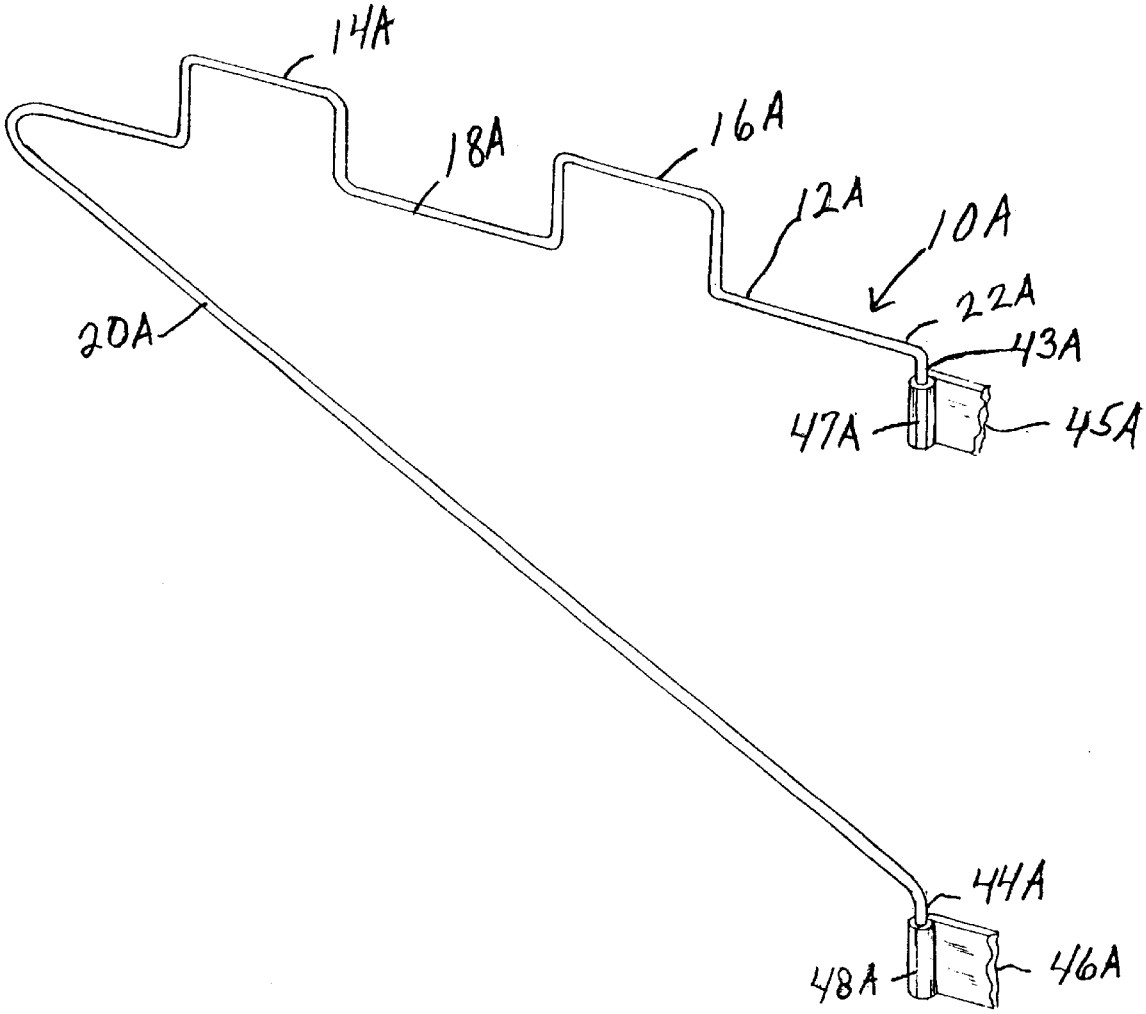
FIG. 2 is a view in side elevation of another embodiment.
Figure 3:
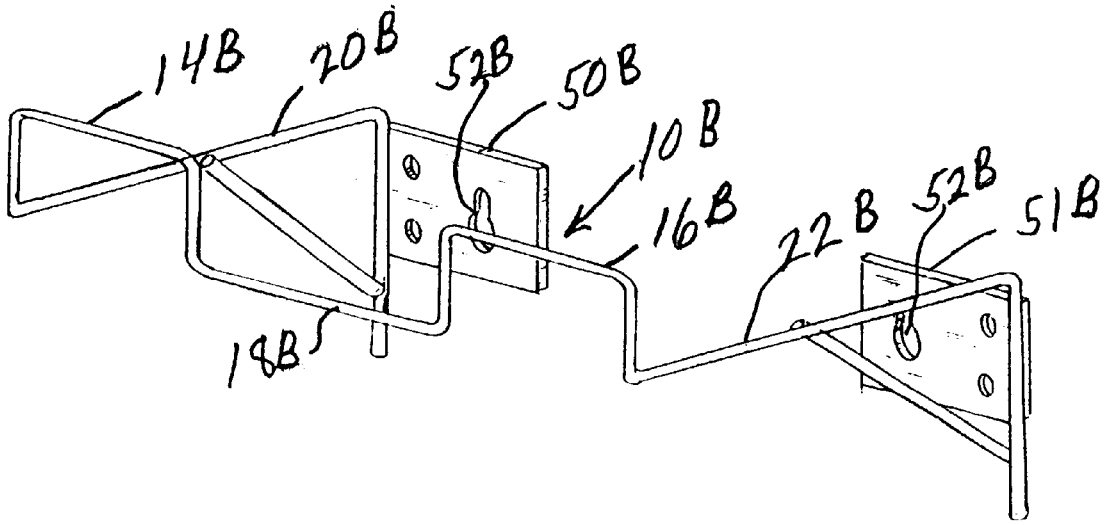
FIG. 3 is a perspective view of still another embodiment.
Figure 4:
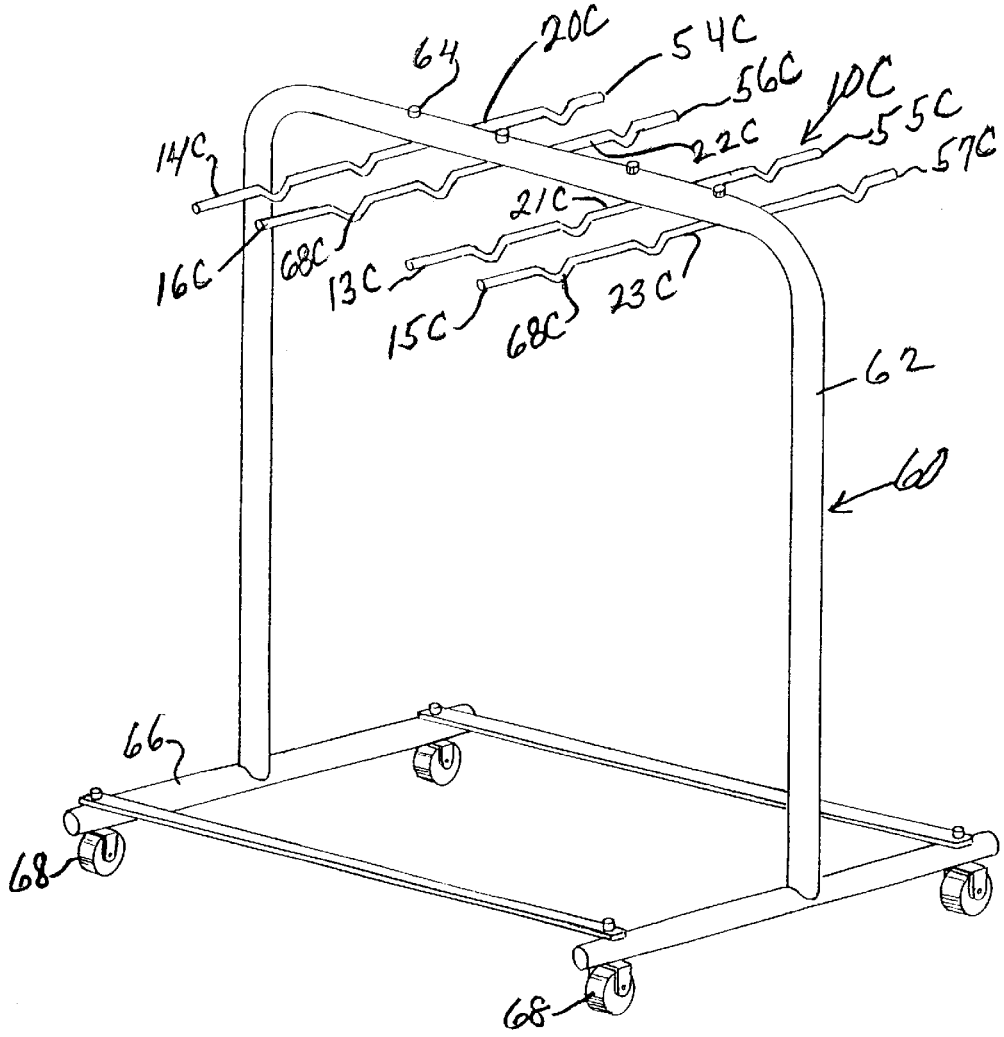
FIG. 4 is a perspective view of yet another embodiment.

FIGS. 2, 3 and 4 represent additional embodiments 10A, 10B and 10C. The same numbers are utilized to refer to the same components except with the suffix "A", "B", and "C". In embodiment 10A shown in FIG. 2, a swivel type unit is provided wherein the supporting section 22A has an upper leg portion 43A for engagement in collar 47A of suspending member 45A. Supporting section 20A extends from support member 14A and has a lower leg portion 44A for seating in collar 48A of suspending member 46A. In this manner, when the support members 14A and 16A are positioned in the openings 32, 33 and 35, 36, the bag can be hung between various positions.

Referring to FIG. 3, embodiment 10B illustrates a unit for attachment to a wall (not shown). Supporting sections in the form of two spaced apart arm sections 20B and 22B are connected to brackets 50B and 51B which in turn are fastened to the wall such as by fastening members extending through openings 52B.

Referring to FIG. 4, embodiment 10C includes a multiplicity of support members such as 13C–16C and 54C–57C. Eight bags such as 30 can be accommodated on the support members with each pair of support members such as 14C and 16C accommodating 2 bags. Undulations 68C provide suitable seating in the openings such as 32 and 33. Supporting sections 20C–23C provide connection with a cart generally 60 by attachment with support arm 62 through which pass the bolts 64. The cart includes a base member 66 with castors 68.

Figure 5:
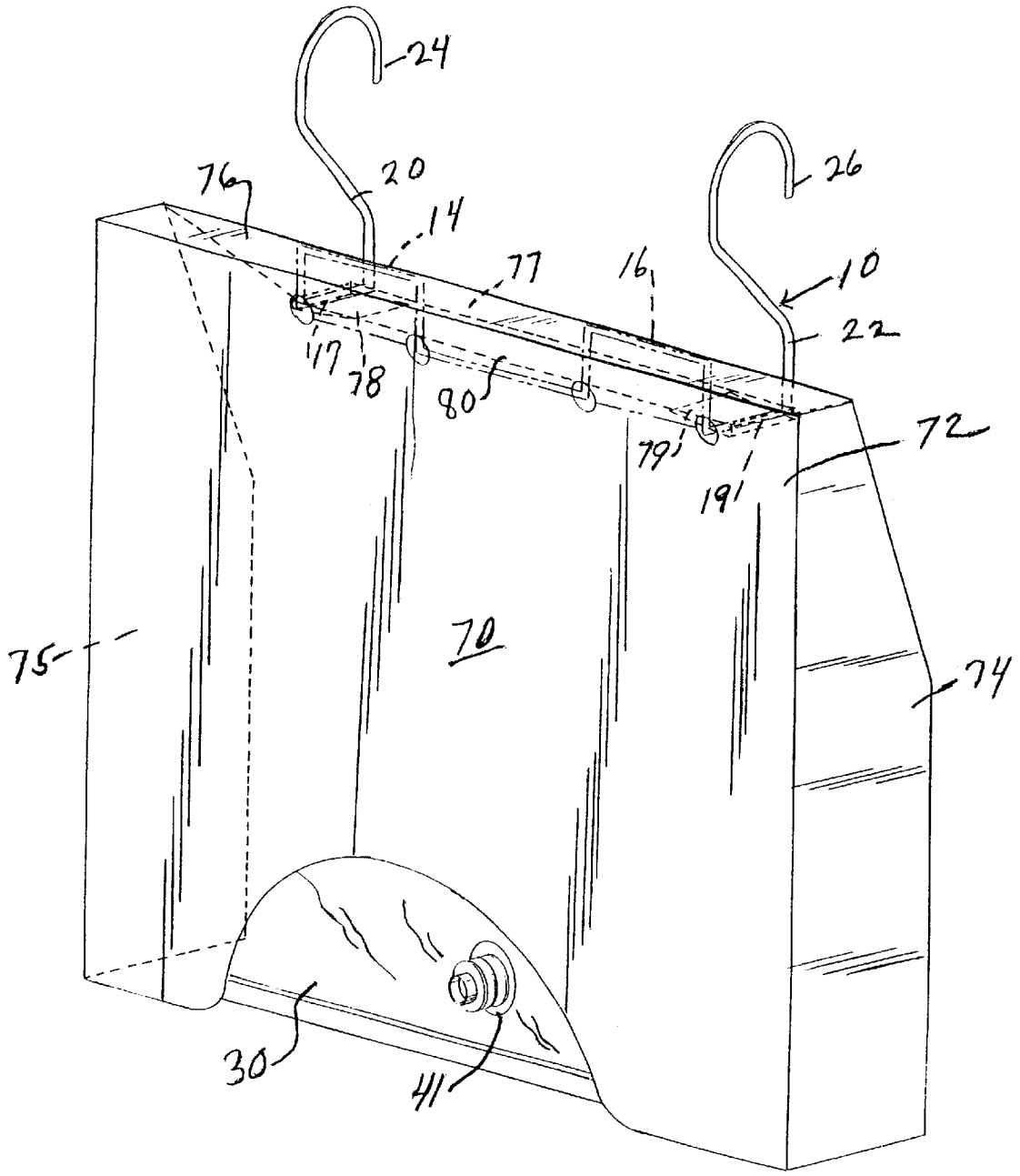
FIG. 5 is a perspective view of a shield for use with the rack of FIG. 1.

As seen in FIG. 5, a shield 70 is afforded for the bag 30 in conjunction with the support rack 10. It includes a front panel 72, two side opposing panels 74 and 75, a top panel 76 from which extends a vertical back panel 77 and a horizontal back panel 80. Opposing flaps (not shown) extend from the ends of back horizontal panel 80 for wrapping around horizontal portions 17 and 19 of supporting sections 20 and 22, respectively. The flaps are connected in this position to the back horizontal panel 80 by Velcro fasteners 78 and 78 attached to both the horizontal panel 80 and the flaps. Shield 70 reduces undesired contact with bag 10 such as with sharp objects. It is composed of a semi-rigid polypropylene plastic material which is translucent.

An important feature of the support racks 10, 10A, 10B and 10C are that they can support a flexible plastic bag containing a large volume of liquid which in the instance of bag 30 is 2.5 gallons. This liquid may be in the form of a concentrated cleaner or sanitizer.

As seen from the previous description, the support rack can take various geometric configurations and is adaptable to being supported from various types of supporting members and in some instances being movable in conjunction therewith. While the racks described herein are preferably made from one piece of wire, i.e., monolithic, they can be composed of several separate parts interconnected such as by welding. However, this would add to the cost. Further, while a shield 70 has been indicated for use with the supported bag 30, it can be eliminated. All such and other modifications within the spirit of the invention are meant to be within its scope as defined by the appended claims.

What is claimed is:

1. A support rack for a plastic container having a content of at least 1.5 gallons of liquid comprising:

a wire body section, including at least two support members for engagement with at least two apertures in the plastic container, the support members positioned with portions facing each other and coplanar with respect to each other;

a connecting section extending between the support members and joining the facing portions thereof and coplanar with respect to the support members; the support members extending in a given direction from the connecting section;

supporting sections extending from portions thereof opposite the facing portions for connection to a suspending support member, the supporting sections extending in part from the support members in the same given direction as the support members and terminating in spaced apart hook members for connection to the suspending support member; and the support members, connecting section, support sections and hook members being monolithic.

2. The support rack as defined in claim 1, wherein the at least two support members are defined by two upwardly extending, essentially U-shaped members and the supporting sections are defined by two spaced apart hook members.

3. The support rack as defined in claim 1, further including a protective cover extending over a top of the rack and over sides thereof.

* * * * *